US008083310B2

(12) United States Patent
Takahashi et al.

(10) Patent No.: US 8,083,310 B2
(45) Date of Patent: Dec. 27, 2011

(54) LIQUID DROPLET EJECTING APPARATUS

(75) Inventors: Yoshikazu Takahashi, Nagoya (JP); Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/396,390

(22) Filed: Mar. 2, 2009

(65) Prior Publication Data

US 2009/0219314 A1 Sep. 3, 2009

(30) Foreign Application Priority Data

Feb. 29, 2008 (JP) ..... 2008-050290

(51) Int. Cl.
*B41J 29/38* (2006.01)

(52) U.S. Cl. ..... 347/12; 400/120.09

(58) Field of Classification Search ..... 347/12, 347/14, 41, 74; 358/1.9, 3.09, 3.12, 3.1
See application file for complete search history.

(56) References Cited

U.S. PATENT DOCUMENTS

| | | | | |
|---|---|---|---|---|
| 4,528,575 | A * | 7/1985 | Matsuda et al. | 347/71 |
| 4,809,016 | A * | 2/1989 | Padalino | 347/41 |
| 5,611,630 | A * | 3/1997 | Dolan et al. | 400/120.09 |
| 5,790,150 | A * | 8/1998 | Lidke et al. | 347/41 |
| 5,847,722 | A * | 12/1998 | Hackleman | 347/19 |
| 6,017,112 | A * | 1/2000 | Anderson et al. | 347/40 |
| 6,019,454 | A * | 2/2000 | Serra et al. | 347/41 |
| 6,027,202 | A * | 2/2000 | Narushima | 347/40 |
| 6,039,434 | A * | 3/2000 | Moroney | 347/43 |
| 6,908,172 | B2 * | 6/2005 | Billow et al. | 347/19 |
| 6,940,618 | B2 * | 9/2005 | Kinas | 358/1.4 |

(Continued)

FOREIGN PATENT DOCUMENTS

| | | | |
|---|---|---|---|
| JP | H02-235759 | A | 9/1990 |
| JP | H02-263650 | A | 10/1990 |
| JP | H09-226201 | A | 9/1997 |
| JP | 2004-255838 | A | 9/2004 |
| JP | 2005-125769 | A | 5/2005 |
| JP | 2006-305911 | A | 11/2006 |
| JP | 2007-176161 | A | 7/2007 |

OTHER PUBLICATIONS

Japan Patent Office; Notice of Reasons for Rejection in Japanese Patent Application No. 2008-050290 mailed Apr. 13, 2010.

*Primary Examiner* — Charlie Peng
*Assistant Examiner* — Peter Radkowski
(74) *Attorney, Agent, or Firm* — Baker Botts L.L.P.

(57) ABSTRACT

A liquid droplet ejecting apparatus includes an ejecting head configured to eject liquid droplets onto an ejected target element to form a of dots arranged at predetermined dot intervals in dot columns. The liquid droplet ejecting head has a flow passage unit including individual flow passages including a first individual flow passage and a second individual flow passage, at least one common liquid chamber in fluid communication with each individual flow passage; and a plurality of nozzles, including a first nozzle fluidly communicating with the first individual flow passage and a second nozzle fluidly communicating with the second flow passage. A control unit causes a liquid droplet to be ejected from the first nozzle, then moves the ejecting head less than the dot interval, then subsequently suspends the first nozzle from ejecting, and ejects a liquid droplet from the second nozzle.

10 Claims, 12 Drawing Sheets

U.S. PATENT DOCUMENTS

| | | | | |
|---|---|---|---|---|
| 7,004,572 | B2 * | 2/2006 | Pinard | 347/74 |
| 2002/0113839 | A1 * | 8/2002 | Hawkins et al. | 347/40 |
| 2002/0154197 | A1 * | 10/2002 | Sakamoto et al. | 347/68 |
| 2004/0095440 | A1 * | 5/2004 | Pinard | 347/74 |
| 2004/0113975 | A1 * | 6/2004 | Brookmire et al. | 347/40 |
| 2004/0160470 | A1 * | 8/2004 | Billow et al. | 347/19 |
| 2004/0169704 | A1 | 9/2004 | Tobita et al. | |
| 2004/0183843 | A1 * | 9/2004 | Walmsley et al. | 347/12 |
| 2005/0088490 | A1 | 4/2005 | Mita | |
| 2007/0120904 | A1 * | 5/2007 | Sekiguchi | 347/85 |

* cited by examiner

LIQUID DROPLET EJECTING APPARATUS

CROSS-REFERENCE TO RELATED APPLICATION

The present application claims priority from Japanese Patent Application No. JP-2008-050290, which was filed on Feb. 29, 2008, the disclosure of which is incorporated herein by reference in its entirety.

BACKGROUND OF THE INVENTION

1. Field of the Invention

The invention relates generally to a liquid droplet ejecting apparatus that ejects liquid droplets.

2. Description of Related Art

A known liquid droplet ejecting apparatus, e.g., a serial ink jet printer, ejects liquid droplets. A known serial ink jet printer, e.g., the one described in Japanese Unexamined Patent Application Publication No. H09-226201 A, includes a transport mechanism that transports a recoding sheet of paper in a predetermined transport direction, a carriage that is reciprocally movable in a widthwise direction, e.g., a scanning direction, which is perpendicular to the transport direction of the recording sheet of paper, and an ink jet head mounted on the carriage. The known ink jet printer ejects ink droplets from a plurality of nozzles onto the recording sheet of paper while reciprocally moving the ink jet head with the carriage in the scanning direction. Thus, the known ink jet printer records a desired image or character on the recording sheet of paper transported by the transport mechanism.

In the known serial ink jet printer, as the speed at which the ink jet head ejects liquid droplets while moving in the scanning direction increases, the space between each dot formed on the recording sheet of paper in the scanning direction decreases, and, as such, the resolution of an image formed on the recording sheet of paper increases. Nevertheless, as the number of dots is increased to increase the image resolution, the size of data, e.g., dot data, for forming this increased number of dots becomes greater, it takes a longer time for data transmission to the printer and the like. In addition, it takes a longer time for the ink jet head to move in the scanning direction, e.g., make a pass, when an increased number of dots at fine dot intervals are formed on the recording paper. Thus, the print speed undesirably is decreased.

Further, in a known ink jet head, a plurality of individual ink flow passages that respectively communicate with a plurality of nozzles are branched off from one common ink chamber (manifold). Thus, ink is supplied from the one common chamber to the plurality of nozzles. When liquid droplets are ejected simultaneously from the plurality of nozzles that communicate with the one common ink chamber, pressure, e.g., ejecting energy, also is applied to ink in the plurality of individual ink flow passages corresponding to these plurality of nozzles simultaneously. After liquid droplets are ejected from all the nozzles, propagation of residual pressure waves, e.g., fluid crosstalk, through the common ink chamber occurs among the nozzles and among the individual ink flow passages that communicate with the nozzles. Mechanical vibrational energy that occurs at the time of ejection of liquid droplets also propagates between the adjacent individual ink flow passages, e.g., structural crosstalk. These crosstalk phenomena adversely affect the characteristics of ejection of liquid droplets from the nozzles.

Fluid crosstalk and structural crosstalk interfere with the ejecting energy applied to ink and causes the liquid droplet ejecting characteristics, e.g., the amount of liquid droplet and liquid droplet speed, to deviate. In addition, fluid crosstalk and structural crosstalk interferes with the accurate timing of ink ejection. Thus, fluid crosstalk and structural crosstalk in the known ink jet head causes print quality to decrease and are particularly problematic in high-resolution printing, such as printing a photograph or the like.

SUMMARY OF THE INVENTION

Therefore, a need has arisen for a liquid droplet ejecting apparatus which overcomes these and other shortcomings of the related art. A technical advantage of the invention is that a liquid droplet ejecting apparatus may be configured to shift the ejection timings of the adjacent nozzles to reduce crosstalk when dots are formed, so that dot columns spaced apart in the scanning direction are shifted in dot position in the scanning direction with respect to the adjacent dot columns.

According to an embodiment of the invention, a liquid droplet ejecting apparatus comprises a liquid droplet ejecting head configured to eject liquid droplets onto the ejected target element to form a plurality of dots arranged at predetermined dot intervals in a plurality of dot columns, the liquid droplet ejecting head comprising a flow passage unit comprising a plurality of individual flow passages arranged in a transport direction substantially perpendicular to the scanning direction, the plurality of individual flow passages comprising a first individual flow passage and a second individual flow passage adjacent to the first individual flow passage in the transport direction, at least one common liquid chamber configured to be in fluid communication with each of the plurality of individual flow passages, and a plurality of nozzles comprising a first nozzle and a second nozzle, wherein the first nozzle is configured to fluidly communicate with the first individual flow passage, and the second nozzle is configured to fluidly communicate with the second individual flow passage. The liquid droplet ejecting head also comprises an actuator unit configured to selectively pressurize liquid in one of the first individual flow passage and the second individual flow passage, thereby ejecting liquid droplets from the corresponding one of the first nozzle and the second nozzle. The liquid droplet ejecting apparatus also comprises a control unit configured to control the actuator unit and the liquid droplet ejecting head, wherein the control unit controls the actuator unit to eject a liquid droplet from the first nozzle during an ejection time interval, then subsequently control the liquid droplet ejecting head to move a predetermined distance in the scanning direction, then subsequently suspend the first nozzle from ejecting, and control the actuator unit to eject a liquid droplet from the second nozzle, wherein the predetermined distance is less than the predetermined dot interval, wherein the control unit controls the actuator unit to eject dots such that positions of the plurality of dots formed in a first dot column are offset from positions of the plurality of dots formed in second dot column adjacent to the first dot column in the scanning direction.

Other objects, features, and advantages of the invention will be apparent to persons of ordinary skill in the art in view of the foregoing detailed description of the invention and the accompanying drawings.

BRIEF DESCRIPTION OF THE DRAWING

For a more complete understanding of the invention, the needs satisfied thereby, and the objects, features, and advantages thereof, reference now is made to the following description taken in connection with the accompanying drawings.

DESCRIPTION OF PREFERRED EMBODIMENTS

Embodiments of the invention and their features and technical advantages may be understood by referring to FIGS. 1-12E, like numerals being used for like corresponding portions in the various drawings.

Figure 1:
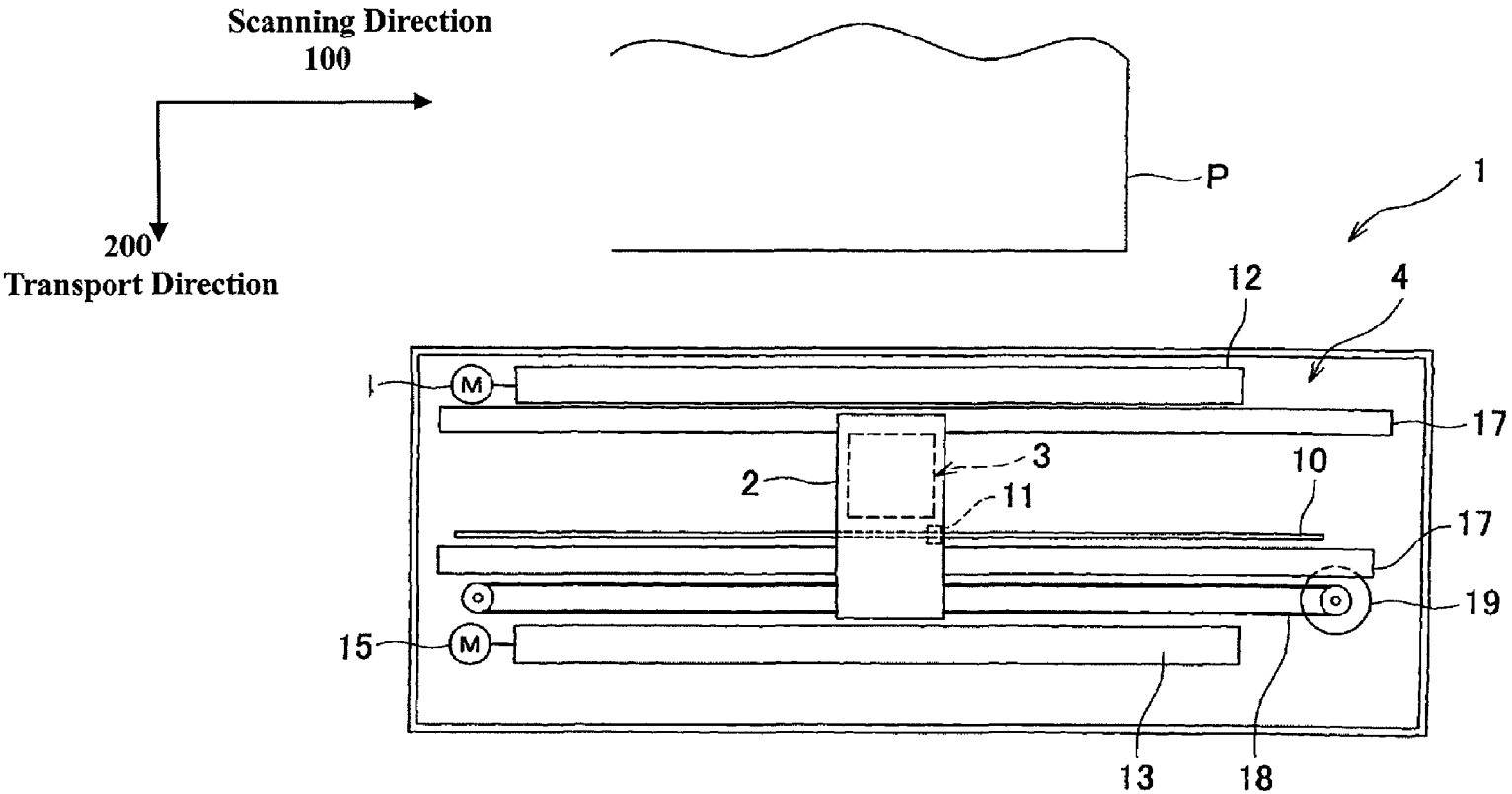
FIG. 1 is a plan, schematic view of a printer according to an embodiment of the invention.

FIG. 1 is a plan, schematic view of the ink jet printer according to an embodiment of the invention. As shown in FIG. 1, printer 1 may comprise a carriage 2, an ink jet head 3, e.g., liquid droplet ejecting head, a transport mechanism 4, e.g., a transport unit; a controller 5, e.g., a control unit, and the like. Carriage 2 may be configured to move reciprocally in a scanning direction 100, e.g., the left-right direction in FIG. 1. Ink jet head 3 may be mounted on carriage 2. Transport mechanism 4 may transport a recording sheet of paper P in a transport direction 200, perpendicular to the scanning direction 100. Controller 5 may govern the operations of ink jet printer 1.

Carriage 2 may be configured to move reciprocally along two guide shafts 17 which extend in a direction parallel to the scanning direction, e.g., the left-right direction in FIG. 1. In addition, an endless belt 18 may be coupled to carriage 2. A carriage drive motor 19 may drive endless belt 18 to move carriage 2 in the scanning direction. Printer 1 may comprise a linear encoder 10 that has many light transmission portions, e.g., slits, arranged at intervals in the scanning direction. Carriage 2 may comprise a transmissive photosensor 11 that has a light-emitting element and a light-receiving element. Thus, printer 1 may determine a current position of carriage 2 in the scanning direction based on a count value, e.g., the number of times of detection, of the light transmission portions of linear encoder 10 detected by photosensor 11, when carriage 2 is moving.

Figure 2:
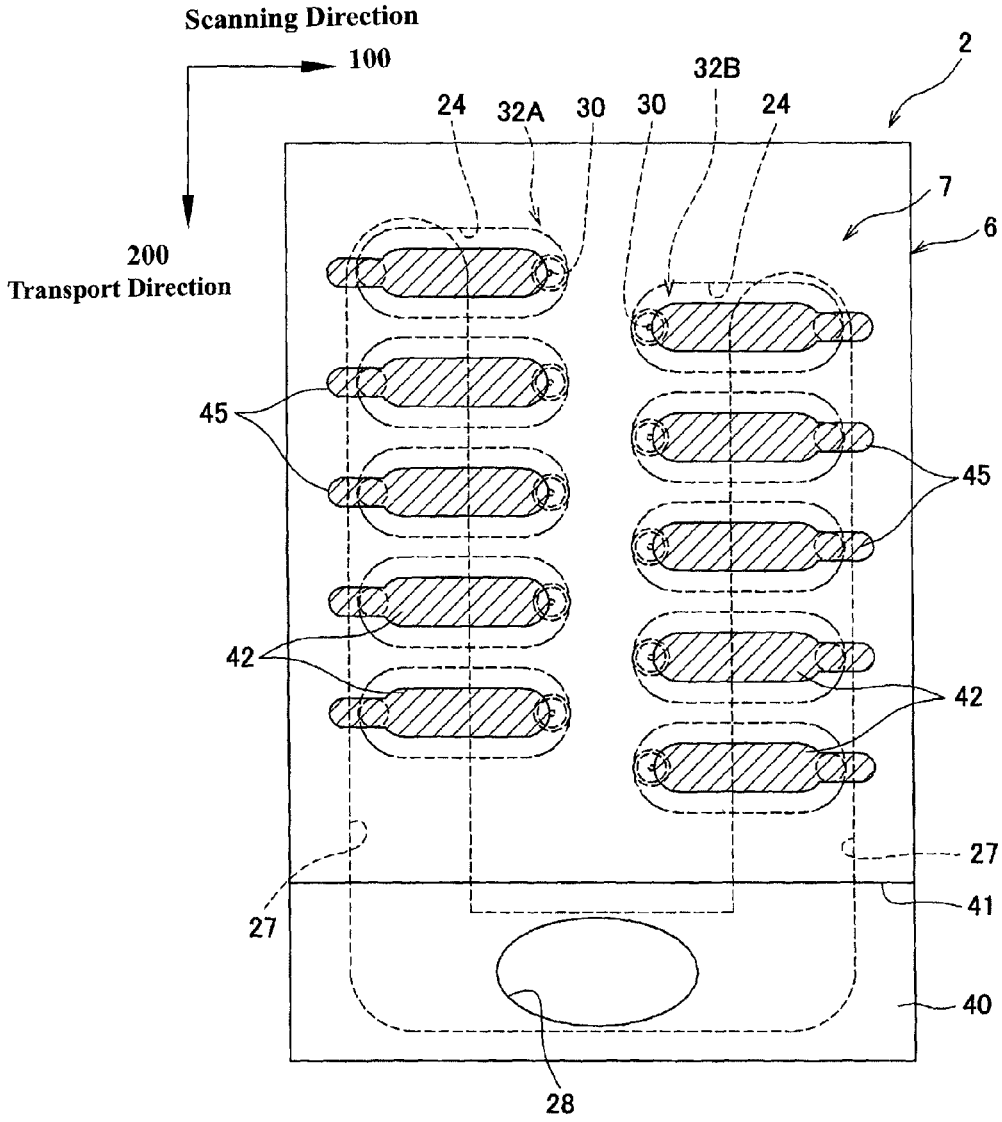
FIG. 2 is a plan view of an ink jet head according to an embodiment of the invention.

As shown in FIG. 2, ink jet head 3 may comprise a plurality of nozzles 30 at the lower surface thereof, e.g., the surface facing recording sheet of paper P, as shown in FIG. 1. Ink jet head 3 may eject ink from the plurality of nozzles 30 onto recording sheet of paper P, which may be transported in transport direction 200 by transport mechanism 4.

Transport mechanism 4 may comprise a paper feed roller 12 arranged upstream of the ink jet head 3 in transport direction 200 and a paper ejection roller 13 arranged downstream of ink jet head 3 in transport direction 200. Paper feed roller 12 and paper ejection roller 13 may be respectively driven to rotate by a paper feed motor 14 and a paper ejection motor 15. Transport mechanism 4 may transport recording sheet of paper P from the upper side of transport mechanism 4, as shown in FIG. 1, to ink jet head 3 by paper feed roller 12, and may eject recording sheet of paper P, on which an image, a character, or the like may be recorded by ink jet head 3, to the lower side of transport mechanism 5 by paper ejection roller 13, as shown in FIG. 1.

Figure 3:
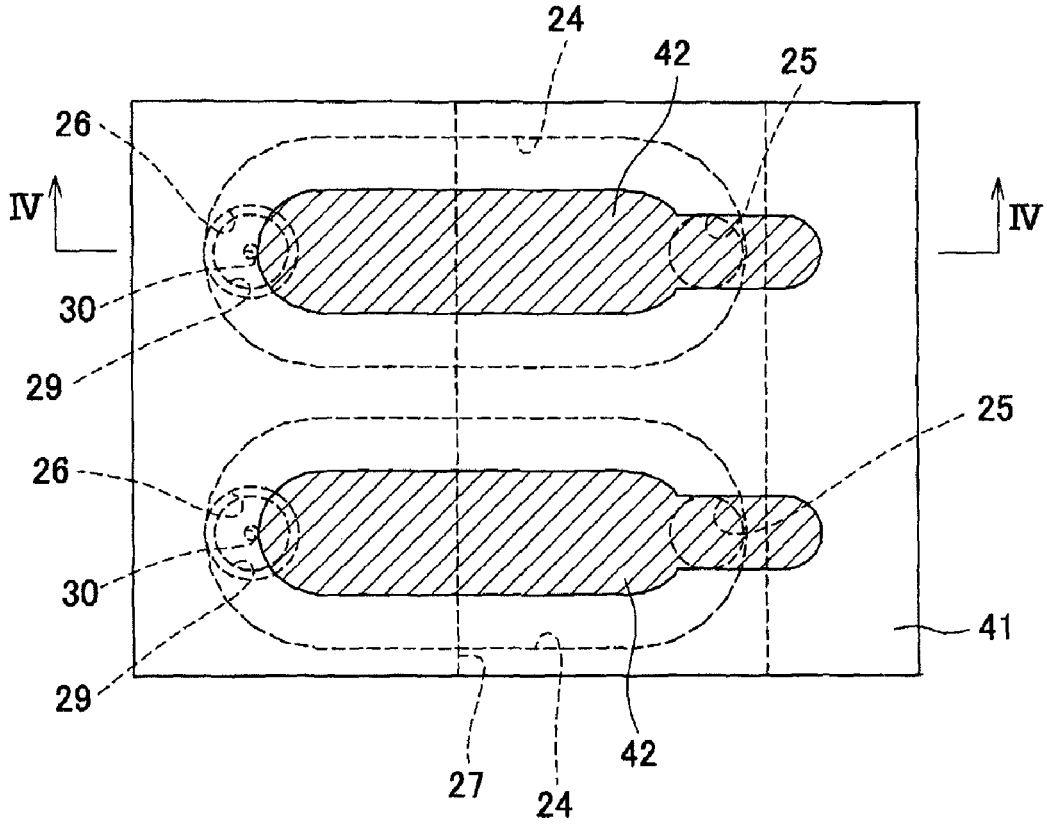
FIG. 3 is an enlarged partial view of FIG. 2.
Figure 4:
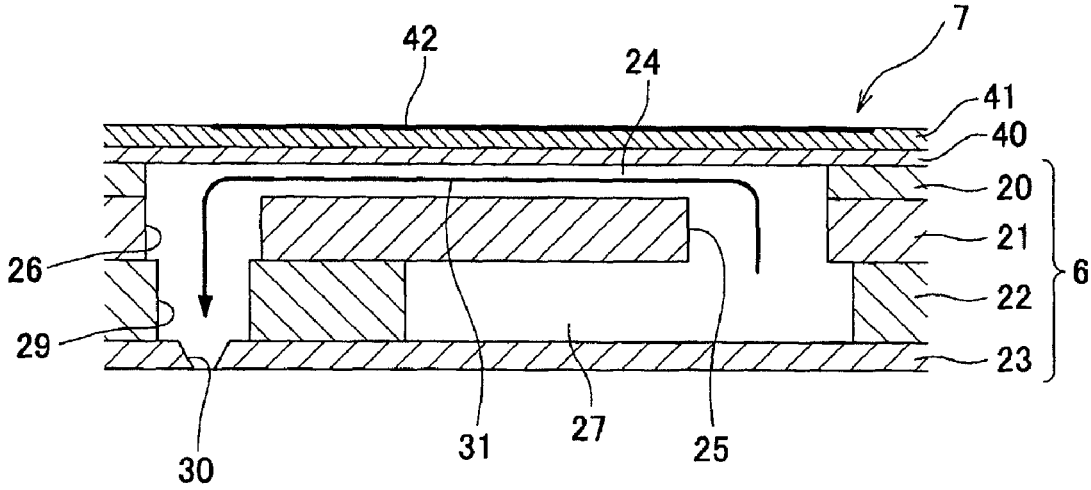
FIG. 4 is a cross-sectional view that is taken along the line IV-IV in FIG. 3.

As shown in FIGS. 2-4, ink jet head 3 may comprise a flow passage unit 6 and a piezoelectric actuator unit 7. Flow passage unit 6 may comprise ink flow passages that comprise nozzles 30 and pressure chambers 24. Actuator unit 7 may apply pressure to ink in each pressure chamber 24.

As shown in FIG. 4, flow passage unit 6 may comprise a cavity plate 20, a base plate 21, a manifold plate 22, and a nozzle plate 23. These four plates 20-23 may be bonded together in a laminated state. Cavity plate 20, base plate 21 and manifold plate 22 each may be a substantially rectangular plate in plan view and made of metal material, e.g., stainless steel. Thus, the ink flow passage, e.g., a manifold 27, and pressure chambers 24 may be formed in these three plates 20-22 by etching. Nozzle plate 23 may be made of polymer synthetic resin material, e.g., a polyimide, and may be bonded onto the lower surface of manifold plate 22 by adhesive agent. Alternatively, nozzle plate 23 may be made of metal material, e.g., stainless steel.

As shown in FIGS. 2-5, cavity plate 20 may be disposed on the uppermost position among the four plates 20-23 and may comprise a plurality of pressure chambers 24 extending through plate 20 and arranged along the plane of plate 20. The plurality of pressure chambers 24 may be arranged in two columns in a staggered manner in transport direction 200, e.g., top-to-bottom direction in FIG. 2. As shown in FIG. 4, the plurality of pressure chambers 24 may be covered with a diaphragm 40 and base plate 21 on the upper and the lower sides, respectively. Each pressure chamber 24 may be formed in a substantially elliptical shape having a long axis in scanning direction 100, e.g., horizontal direction in FIG. 2, in plan view.

As shown in FIGS. 3 and 4, communication holes 25 and 26 may be formed respectively at positions of base plate 21, which overlap each of the longitudinal ends of each pressure chamber 24 in plan view. Manifold plate 22 may comprise two manifolds 27, e.g., common liquid chambers, which may extend in transport direction 200, so as to overlap both communication hole 25 and the side portions of pressure chambers 24 arranged in two columns in plan view. These two manifolds 27 may communicate with an ink supply port 28 formed in diaphragm 40. Ink may be supplied from an ink tank (not shown) through ink supply port 28 to manifolds 27. The plurality of communication holes 29 which are continuous with the plurality of communication holes 26 may be positioned in manifold plate 22. The plurality of communication holes 29 may overlap one end of the plurality of pressure chambers 24 opposite the manifolds 27 in plan view.

The plurality of nozzles 30 may be disposed at positions of nozzle plate 23 which corresponds to the positions of the plurality of communication holes 29 in plan view. As shown in FIG. 2, the plurality of nozzles 30 may be arranged to respectively overlap one end of the plurality of pressure chambers 24 opposite the manifolds 27. The plurality of pressure chambers 24 may be arranged in two columns in transport direction 200. The plurality of nozzles 30 may be arranged in a staggered manner so as to form two nozzle columns 32A and 32B, arranged in scanning direction 100 in correspondence with the plurality of pressure chambers 24 in a staggered arrangement. Nozzle column 32A may be arranged so as to be shifted in transport direction 200 by half the length of the arrangement interval of nozzles 30 from nozzle column 32B. For example, two nozzle columns 32A and 32B may be arranged at an interval of one 150th inch (≈169.3 μm) in scanning direction 100, and the nozzles 30 of each of the nozzle columns 32A and 32B also may be arranged at intervals of one 150th inch (≈169.3 μm). The interval, e.g., one 150th inch (≈169.3 μm), of the two nozzle columns 32A and 32B in the scanning direction may be set as an integral multiple of the resolution of a printing image.

As shown in FIG. 4, manifolds 27 may communicate through communication holes 25 with pressure chambers 24. Pressure chambers 24 may communicate through communication holes 26 and 29 with nozzles 30. Flow passage unit 6 may comprise the plurality of individual ink flow passages 31 which may extend from manifolds 27 through pressure chambers 24 to nozzles 30.

FIG. 2 illustrates one type of flow passage structure. Ink jet head 3 may be a color ink jet head 3 which may comprise a plurality of flow passage structures arranged in scanning direction 100 and which may be configured to eject multiple color inks, e.g., black, yellow, cyan, and magenta, respectively.

As shown in FIGS. 2-4, piezoelectric actuator unit 7 may comprise diaphragm 40, a piezoelectric layer 41 and a plurality of individual electrodes 42. Diaphragm 40 may be disposed on the upper surface of flow passage unit 6, e.g., cavity plate 20, to cover the plurality of pressure chambers 24. Piezoelectric layer 41 may be disposed on the upper surface of diaphragm 40 and may face the plurality of pressure chambers 24. The plurality of individual electrodes 42 may be disposed on the upper surface of piezoelectric layer 41.

Figure 5:
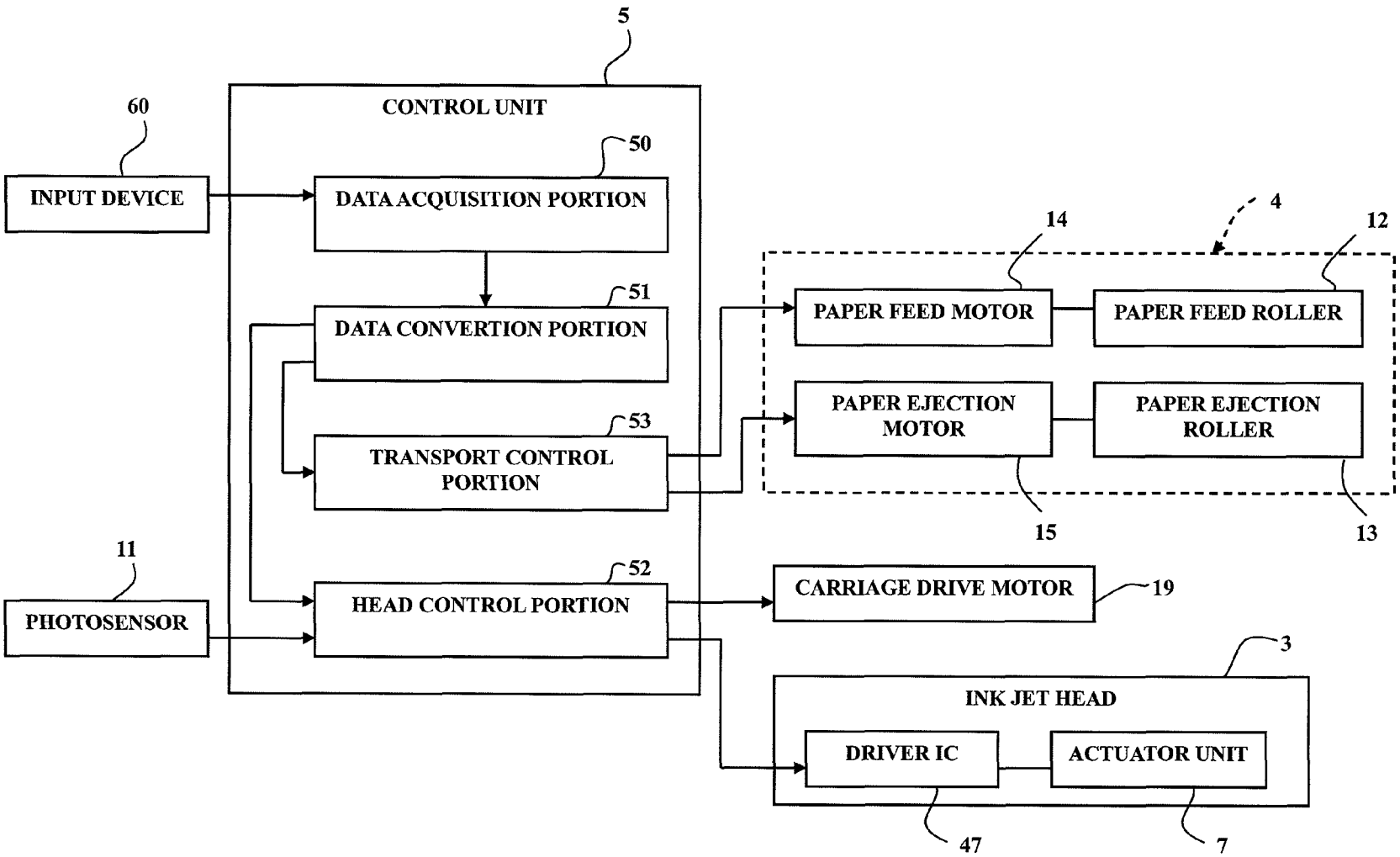
FIG. 5 is a block diagram that illustrates the electrical configuration of the printer according to an embodiment of the invention.

Diaphragm 40 may be a substantially rectangular metal plate and may comprise iron-based alloy, e.g., stainless steel, a copper-based alloy, a nickel-based alloy, titanium-based alloy, or the like. Diaphragm 40 may be bonded to cavity plate 20, such that diaphragm 40 is disposed on the upper surface of cavity plate 20 to cover the plurality of pressure chambers 24. The upper surface of conductive diaphragm 40 may function as a common electrode which may be positioned on the lower surface side of piezoelectric layer 41 and which may generate an electric field in piezoelectric layer 41 in a thickness direction between the upper surface of diaphragm 40 and the plurality of individual electrodes 42 positioned on the upper surface of piezoelectric layer 41. Diaphragm 40 may serve as the common electrode and may be connected to a ground wire of a driver IC 47, as shown in FIG. 5. Driver IC47 may drive actuator unit 7.

Piezoelectric layer 41 may comprise a piezoelectric material, e.g., lead zirconate titanate, which is a ferroelectric substance and a solid solution of lead titanate and lead zirconate. As shown in FIG. 2, piezoelectric layer 41 may be formed continuously over the plurality of pressure chambers 24 on the upper surface of diaphragm 40. Piezoelectric layer 41 may be polarized in the thickness direction at least in portions which face pressure chambers 24.

The plurality of individual electrodes 42 may be positioned in the regions of the upper surface of piezoelectric layer 41 which corresponds to the area of the plurality of pressure chambers 24, respectively. Each individual electrode 42 may have a substantially elliptical, planar shape with a size less than that of each pressure chamber 24, and may face the center portion of corresponding pressure chamber 24. A plurality of contacts 45 may extend from the ends of the plurality of individual electrodes 42, respectively, in the longitudinal direction of individual electrodes 42. The plurality of contacts 45 may be electrically connected to driver IC 47 through a flexible printed circuit ("FPC"). Consequently, any one of the two potentials, e.g., a predetermined driving potential and a ground potential, may be applied selectively from driver IC 47 to the plurality of individual electrodes 42.

When a predetermined driving potential is applied from driver IC 47 to one of the plurality of individual electrode 42, a potential difference may occur between individual electrode 42 and diaphragm 40, which serves as the common electrode. In this manner, an electric field in the thickness direction may be applied to piezoelectric layer 41 held between individual electrode 42 and diaphragm 40. The direction of the electric field may be parallel to the polarized direction of piezoelectric layer 41, such that the regions of piezoelectric layer 41, which correspond to individual electrode 42, may contract in a planar direction perpendicular to the thickness direction. Because diaphragm 40, disposed below piezoelectric layer 41, is fixed to cavity plate 20, when piezoelectric layer 41 contracts in a planar direction, the portion of diaphragm 40, which covers pressure chamber 24, may deform convexly toward pressure chamber 24. Consequently, the volume of pressure chamber 24 may decrease to increase the ink pressure in pressure chamber 24, and ink may be ejected from nozzle 30 which is in fluid communication with pressure chamber 24.

In piezoelectric actuator unit 7, the amount or number of liquid droplets ejected from nozzle 30 may be varied, e.g., a liquid droplet gradation may be achieved, by varying the characteristic of an electrical signal applied from driver IC 47, e.g., by varying a voltage, pulse width, pulse shape, or pulse number. Consequently, nozzles of the same size may be used to produce ink dots of various sizes. Thus, it is not necessary to increase the number of nozzles in a inkjet head for the purpose of producing dots of various sizes. Therefore, the size of the inkjet head may be reduced.

As shown in FIG. 5, controller 5, e.g., the control unit, may comprise a central processing unit ("CPU"); a read only memory ("ROM") which stores various programs, data, and the like, for controlling the overall operations of printer 1; a random access memory ("RAM") which temporarily stores data and the like, processed in the CPU; an input/output interface which exchanges signals with an external device; and the like.

Controller 5 also may comprise a data acquisition portion 50, e.g., a data acquisition unit; a data conversion portion 51, e.g., a data conversion unit; a head control portion 52; and a transport control portion 53. Data acquisition portion 50 may acquire dot data for forming a plurality of dots, corresponding to a desired print image, on a recording sheet of paper P from an input device 60, e.g., a general purpose computer or a personal computer ("PC"). Data conversion portion 51 may convert the dot data acquired by data acquisition portion 50 into converted dot data by which ink jet head 3 performs printing or recording on the recording sheet of paper. Based on the converted data, a liquid droplet of a predetermined color, e.g., yellow ("Y"), magenta ("M"), cyan ("C"), or black ("Bk"), and a predetermined size may be discharged by ink jet head 3 to a predetermined location on the recording sheet of paper.

Head control portion 52 may control carriage drive motor 19 which drives carriage 2 and driver IC 47 which drives actuator unit 7 of ink jet head 3, based on the converted dot data generated by data conversion portion 51, positional information for carriage 2 in the scanning direction detected by photosensor 11, and the like, and may instruct ink jet head 3 to eject liquid droplets onto the recording sheet of paper P while inkjet head 3 is moved along scanning direction 100. Transport control portion 53 may control paper feed motor 14 and paper ejection motor 15, which drive paper feed roller 12 and paper ejection roller 13, respectively, of transport mechanism 4, based on the converted dot data generated by data conversion portion 51, and may transport the recording sheet of paper P along transport direction 200 by a predetermined distance after each pass of carriage 2 along scanning direction 100.

Data acquisition portion 50 may comprise an input/output interface which exchanges information with input device 60. The functions of data conversion portion 51, transport control portion 53, and head control portion 52 may be implemented based on various control programs stored in the ROM of controller 5.

In order to reduce data transmission time from input device 60, e.g., a general purpose computer or a PC, to controller 5 of printer 1, dot data, e.g., first dot data, for forming a print image having a relatively low resolution may be acquired from input device 60 by data acquisition portion 50. Data conversion portion 51 of controller 5 may convert the low resolution dot data acquired from input device 60 by data acquisition portion 50 into a converted dot data, e.g., second dot data, for achieving enhanced print quality.

Figure 6:
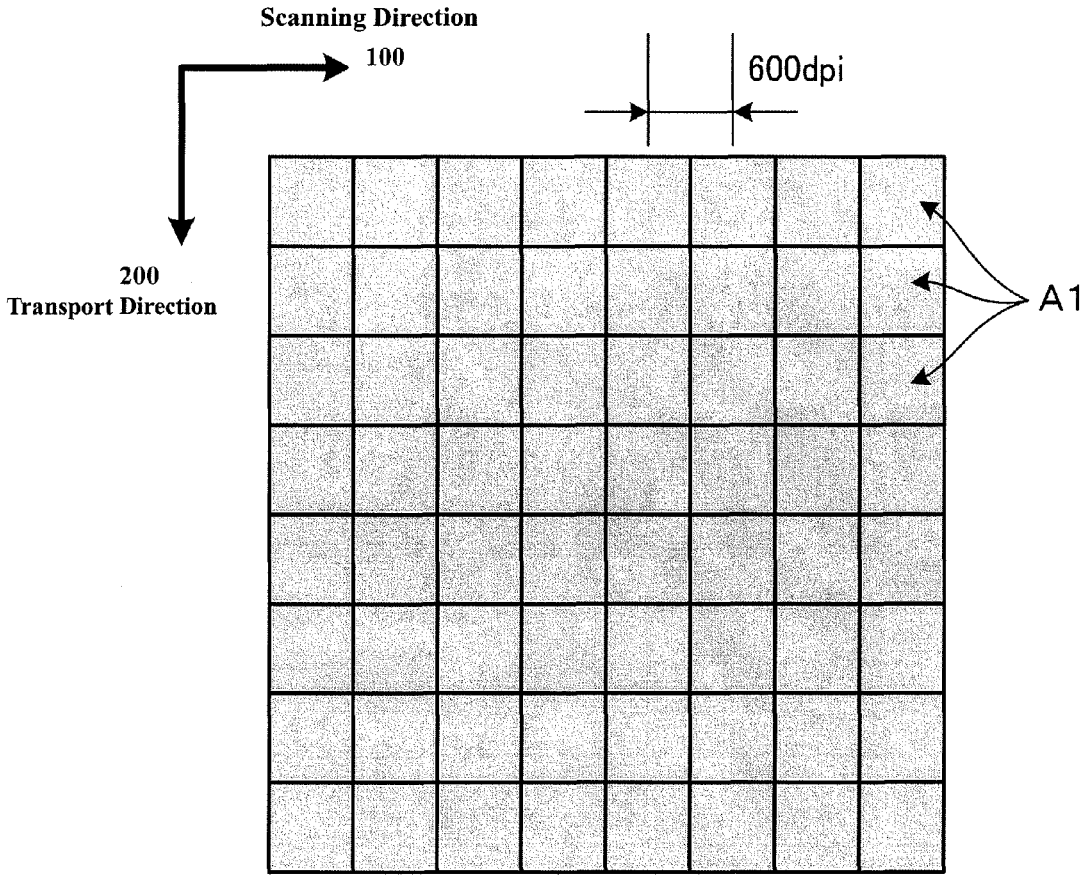
FIG. 6 is a diagram that illustrates the dot arrangement of first dot data input from an input device according to an embodiment of the invention.

FIG. 6 illustrates the dot arrangement when ink dots are formed on the recording sheet of paper P based on the first dot data from input device 60. The first dot data acquired from input device 60 may correspond, respectively, to a plurality of first regions A1 which are positioned at relatively large dot intervals, e.g., resolution 600 dpi ("dots per inch"), in scanning direction 100 and in transport direction 200. For example, first region A1 associated with one first dot data may be a square region that has an area of a dot in a resolution of 600 dpi.

Figure 7:
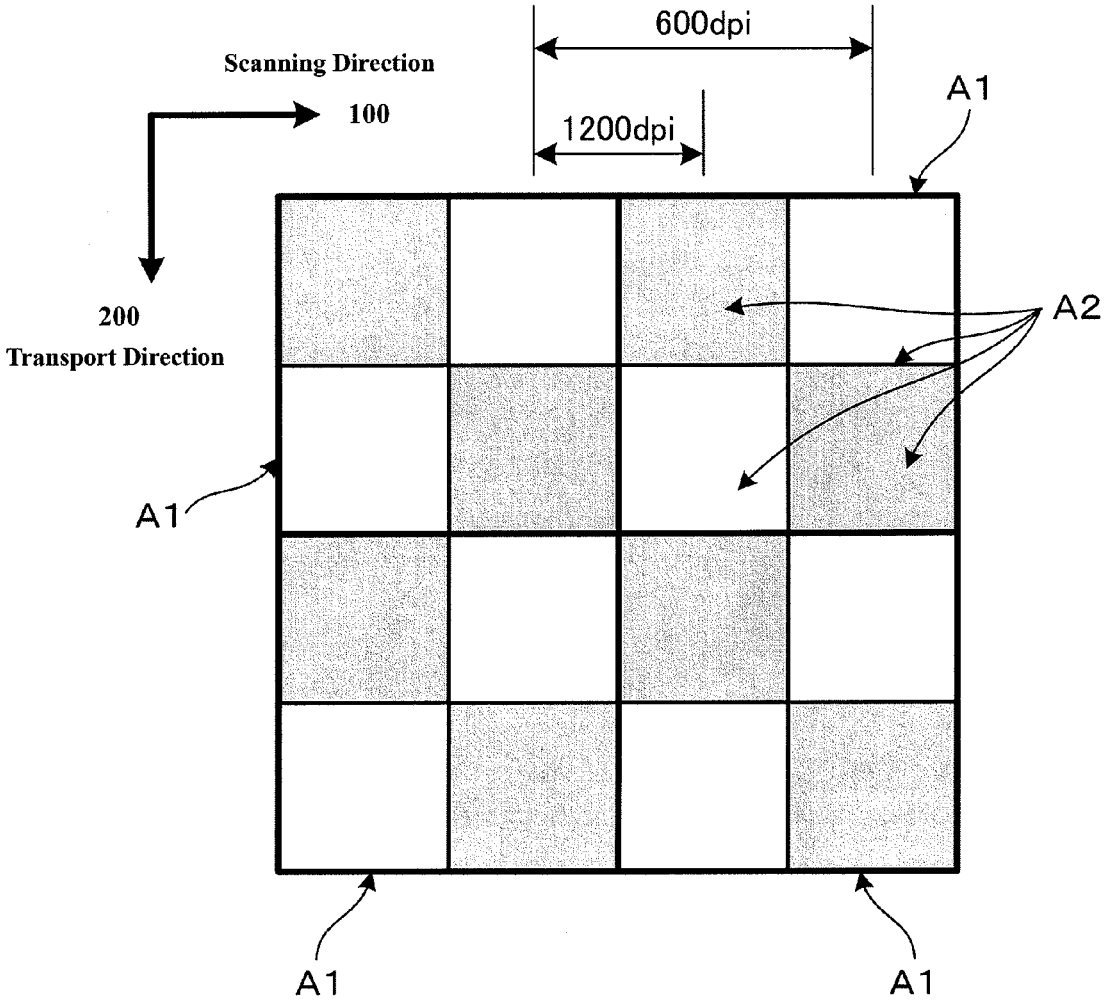
FIG. 7 is a diagram that illustrates data conversion in a data conversion portion according to an embodiment of the invention.

FIG. 7 illustrates the dot arrangement when ink dots are formed on the recording sheet of paper P, based on converted data, e.g., second dot data, from data conversion portion 51. Data conversion portion 51 may divide first region A1, associated with the first dot data, in two directions, e.g., scanning direction 100 and transport direction 200, and may divide one first region A1 into four second regions A2. Second regions A2 may be arranged in scanning direction 100 and in transport direction 200 at half the dot intervals of first region A1 with twice the resolution, e.g., 1200 dpi. Data conversion portion 51 may generate second dot data representing the four second regions A2 based on the first dot data.

Data conversion portion 51 may generate second dot data which represents partially omitted dots in scanning direction 100, as shown in FIG. 7. A dot may be formed only in every other region A2 in scanning direction 100. Dots may be formed in every other second region A2 which may be arranged at intervals of a dot in a 1200 dpi resolution in the scanning direction. Second dot data may be generated, so that dots are formed in every other second regions A2 which are arranged at intervals of a dot in 1200 dpi resolution in transport direction 200.

Second dot data may be generated, such that the color and the intensity of each second regions vary more smoothly between second regions positioned in adjacent first regions A1, as compared with the color and intensity of first dot data.

Figure 8:
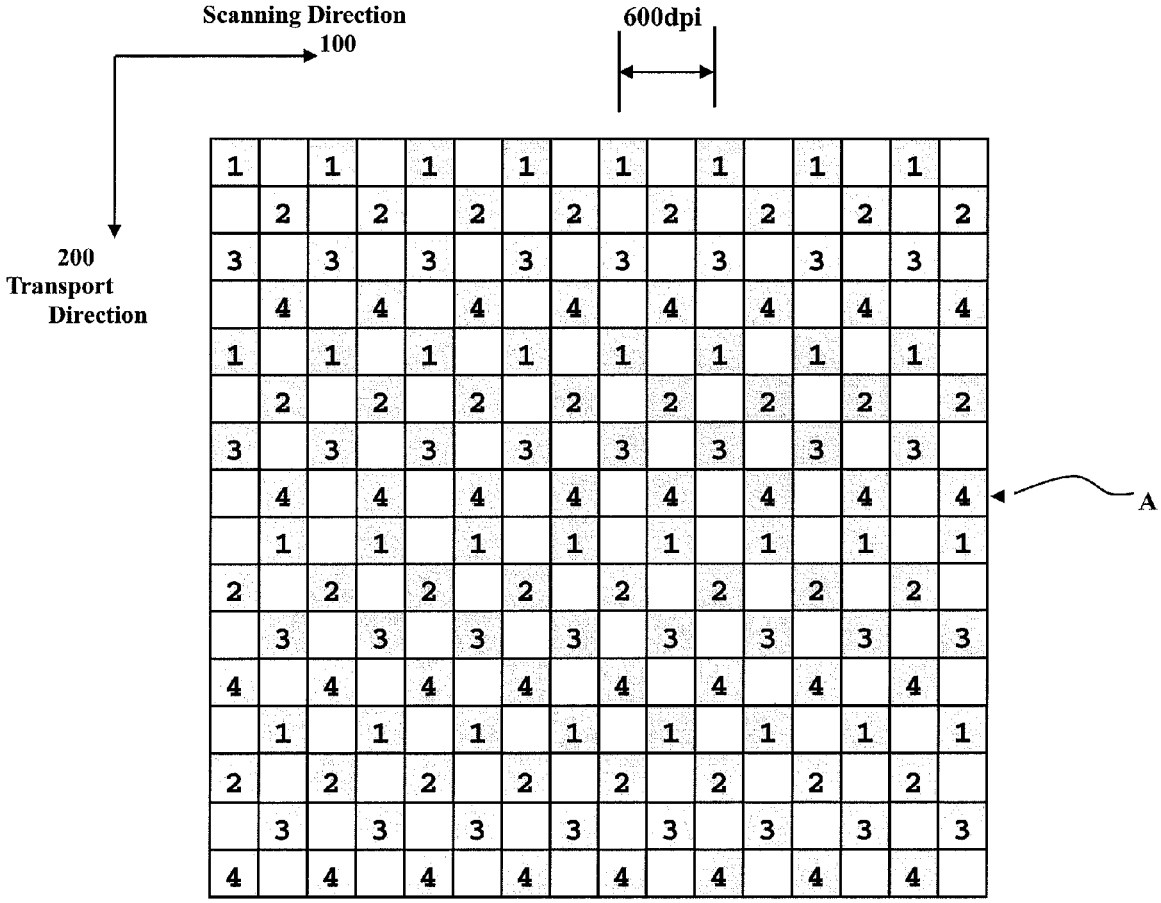
FIG. 8 is a diagram that illustrates the dot arrangement of converted second dot data according to an embodiment of the invention.

FIG. 8 illustrates the dot arrangement of converted second dot data. As shown in FIG. 8, each dot is labeled with a numeral which represents the number of the pass during which the dot was formed. Dots may be formed in every other second regions A2 arranged in scanning direction 100 and in transport direction 200, based on the second dot data. Consequently, a plurality of dots may be arranged in a staggered manner. A plurality of dot columns may be arranged at relatively large dot intervals, e.g., a distance of a dot in 600 dpi, in scanning direction 100 and may be formed, such that the positions of dots in scanning direction 100 are offset from the positions of dots in the adjacent dot columns in transport direction.

In the above dot arrangement, print quality may degrade slightly due to the omitted dots, as compared with the high-resolution printing, e.g., 1200 dpi, in which dots are not omitted. Nevertheless, because the positions of dots are shifted in scanning direction 100 between the adjacent dot columns, the effect of partial dot omission may be inconspicuous. Thus, print quality close to high-resolution printing, e.g., 1200 dpi, may be achieved. In addition, because the number of dots in each dot column in scanning direction 100 decreases, the time for printing each dot column may decrease, and print speed may increase.

A staggered dot arrangement may be formed, such that dot columns arranged at relatively large dot intervals in the scanning direction may shift the positions of dots in scanning direction 100 between the adjacent dot columns, in order to reduce crosstalk which occurs among the nozzles in the same nozzle column, which communicate with the same manifold 27.

Fluid and structural crosstalk may occur between adjacent nozzles 30 or between adjacent pressure chambers 24, which may reduce print quality. Effects of fluid and structural crosstalk may be more noticeable in a high resolution printing process. In addition, uneven rotation may occur in carriage drive motor 19 which drives carriage 2, and, consequently, the scanning speed of carriage 2 may fluctuate and may reduce print quality. When the scanning speed of carriage 2 fluctuates, the interval at which photosensor 11 detects the light transmission portions of linear encoder 10 may become inconstant. Thus, the frequency at which liquid droplets are ejected by ink jet head 3, e.g., the driving frequency of actuator unit 7, may fluctuate. Fluctuations in the driving frequency may result in variations in the amount of liquid droplets ejected and may cause uneven printing. When liquid droplets are ejected simultaneously from a plurality of nozzles 30 in the same nozzle column 32, crosstalk may occur among the plurality of nozzles 30, and print quality may decrease substantially.

Figure 9B:
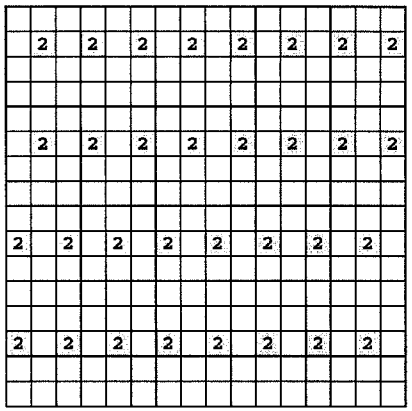
FIG. 9B is a diagram that illustrates the positions of dots formed in a second pass for forming the dot arrangement as shown in FIG. 8.
Figure 9D:
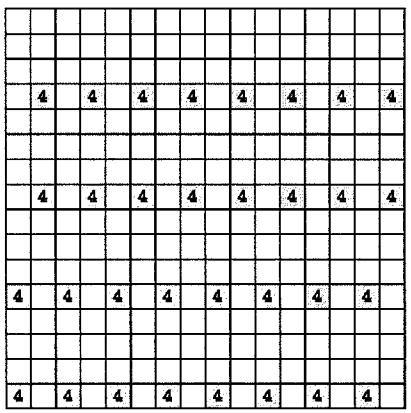
FIG. 9D is a diagram that illustrates the positions of dots formed in a fourth pass for forming the dot arrangement, as shown in FIG. 8.

FIGS. 9A-9D illustrates the positions of dots formed in each pass to form the dot arrangement shown in FIG. 8. The dot arrangement may be formed by four carriage scanning passes. The numerals written on the dots may represent the number of the pass during which the dots were formed. As shown in FIG. 9E, four nozzles 30*a*-30*d* may be arranged in two columns in a staggered manner. Four nozzles 30*a*-30*d* may be positioned among a plurality of nozzles 30 of ink jet head 3. Two nozzles 30*a* and 30*c* may be positioned in a left-side nozzle column 32A, and two nozzles 30*b* and 30*d* may be positioned in a right-side nozzle column 32B. Each nozzle may communicate with manifolds 27 through its individual ink flow passage.

As shown in FIG. 8, in order to form dots on the recording sheet of paper P in every other regions in scanning direction 100, a liquid droplet may be ejected in every other regions of the recording sheet of paper P from each of the four nozzles 30 while the four nozzles 30 move in scanning direction 100. When a liquid droplet is ejected from a nozzle 30, e.g., a first nozzle, ejection of a liquid droplet from nozzle 30 may be suspended at the next interval during which ink jet head 3 moves nozzle 30 over the next region in scanning direction 100. During each interval, the first nozzle may be moved by a predetermined scanning distance, e.g., a distance of a dot interval in 1200 dpi, which is half of the dot interval in 600 dpi in scanning direction 100. During the interval in which the first nozzle 30 is suspended from ejecting liquid droplets, another nozzle 30, e.g., a second nozzle, which is positioned in nozzle column 32 and is adjacent to the first nozzle in transport direction 200, may eject a liquid droplet.

Actuator unit 7 may be configured to apply pressure independently to each of the plurality of pressure chambers 24. Thus, each individual nozzle 30 within a nozzle column 32 may eject liquid droplets at a specific time independently of other nozzles. The timings of ejections from nozzles 30 located adjacent to each other may be offset from one another, such that adjacent nozzles may not eject liquid droplets simultaneously.

Figure 9A:
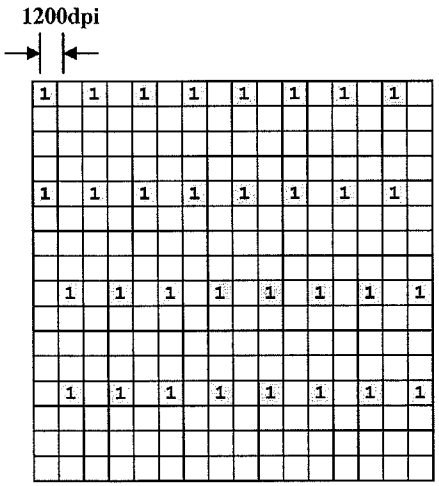
FIG. 9A is a diagram that illustrates the positions of dots formed in a first pass for forming the dot arrangement, as shown in FIG. 8.

As shown in FIG. 9A, during a first ejection interval of the first pass, when ink jet head 3 is located at the end position in scanning direction 100, liquid droplets may be ejected from nozzles 30*a* and 30*b* which respectively positioned in nozzle columns 32A and 32B, and nozzles 30*c* and 30*d* may be suspended from ejecting liquid droplets.

Subsequently, ink jet head 3 may move with carriage 2 in scanning direction 100 by a predetermined scanning distance, e.g., a distance of a dot in 1200 dpi. Then, during a second ejection interval after ink jet head has moved by the predetermined scanning distance, nozzles 30*a* and 30*b* may be prevented from ejecting liquid droplets, and liquid droplets may be ejected from nozzles 30*c* and 30*d* which had been prevented from ejecting liquid droplets during the previous ejection interval.

In this manner, the ejection timings of nozzles 30 located adjacent to each other in the transport direction, e.g., nozzle 30*a* being adjacent to nozzle 30*c* and nozzle 30*b* being adjacent to nozzle 30*d*, may be offset from one another. The offset of ejection timings may reduce both the fluid crosstalk that occurs due to mutual propagation of pressure waves through the manifold 27 and the structural crosstalk that occurs due to mutual propagation of vibration of diaphragm 40 and vibration of piezoelectric layer 41. The possibility of overheating of driver IC47 also may be reduced because the number of nozzles 30 driven by actuator unit 8 to eject liquid droplets simultaneously is reduced. The aforementioned process of liquid droplet ejection and ejection prevention may be performed repeatedly during the first pass to form a dot arrangement, as shown in FIG. 9A.

After the first pass, transport mechanism 4 may move the recording sheet of paper in transport direction 200 by a predetermined distance, e.g., the distance of a dot in 1200 dpi. Subsequently, printing in the second pass may begin. During the second pass, each nozzle 30 may alternate the liquid droplet ejecting operation and the ejection prevention operation repeatedly. During the second pass, the position of dot columns may be shifted by the distance of a dot in 1200 dpi in scanning direction 100 from the dot columns formed in the first pass, e.g., dot columns with dots labeled "1" in FIG. 9A.

Figure 9C:
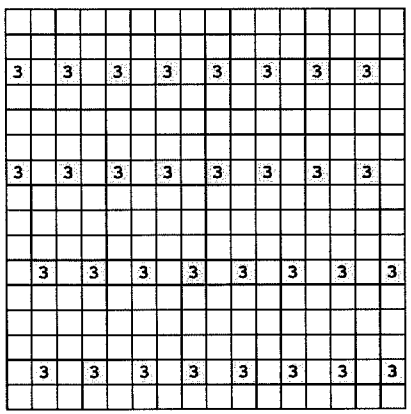
FIG. 9C is a diagram that illustrates the positions of dots formed in a third pass for forming the dot arrangement, as shown in FIG. 8.
Figure 9E:
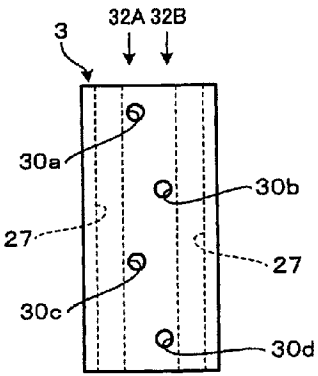
FIG. 9E is a plan view that illustrates the positions of nozzles of a inkjet head for forming the dot arrangement, as shown in FIG. 8.
Figure 10B:
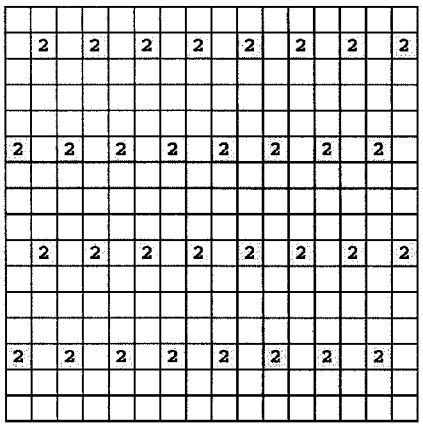
FIG. 10B is a diagram that illustrates the positions of dots formed in a second pass according to the another embodiment of the invention.
Figure 10D:
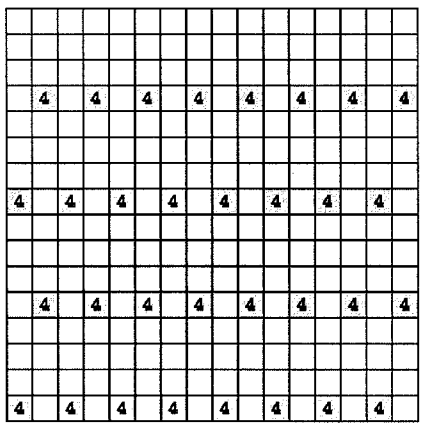
FIG. 10D is a diagram that illustrates the positions of dots formed in a fourth pass according to the another embodiment of the invention.
Figure 10A:
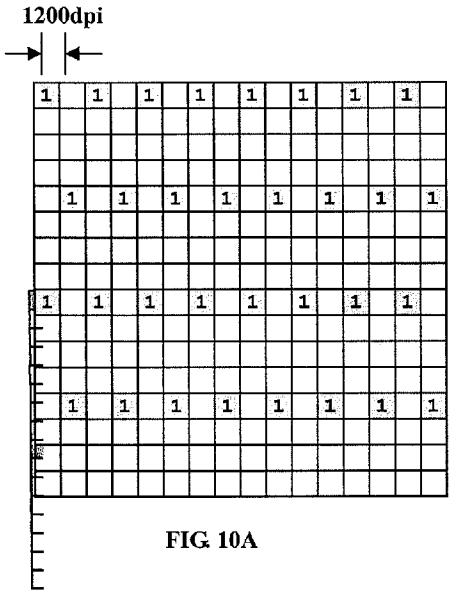
FIG. 10A is a diagram that illustrates the positions of dots formed in a first pass according to another embodiment of the invention.
Figure 10C:
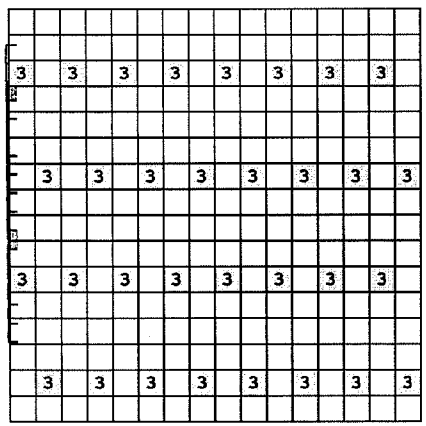
FIG. 10C is a diagram that illustrates the positions of dots formed in a third pass according to the another embodiment of the invention.
Figure 10E:
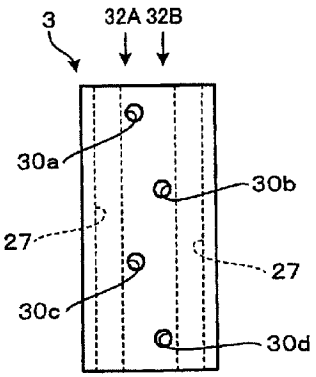
FIG. 10E is a plan view that illustrates the positions of nozzles of a inkjet head for forming the dot arrangement, as shown in FIGS. 10A-10D.
Figure 11:
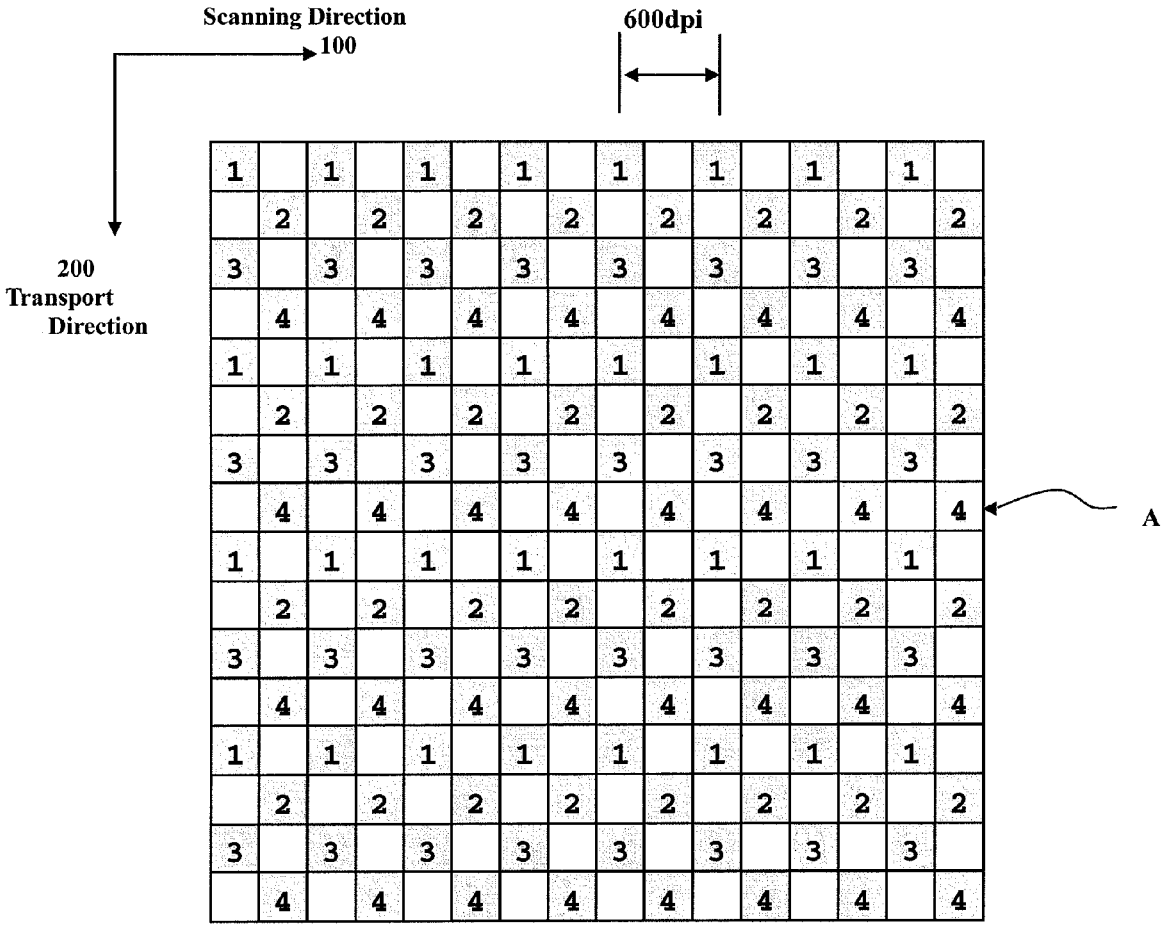
FIG. 11 is a diagram that illustrates the arrangement of dots formed in accordance with a known liquid droplet ejecting method.
Figure 12B:
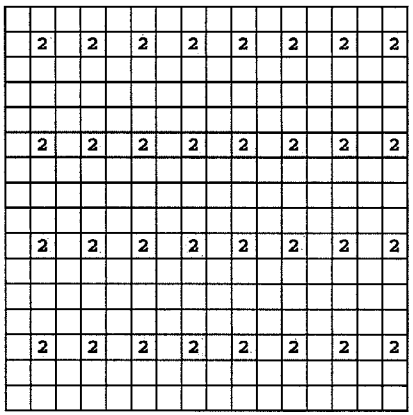
FIG. 12B is a diagram that illustrates the positions of dots formed in a second pass for forming the dot arrangement, as shown in FIG. 11.
Figure 12D:
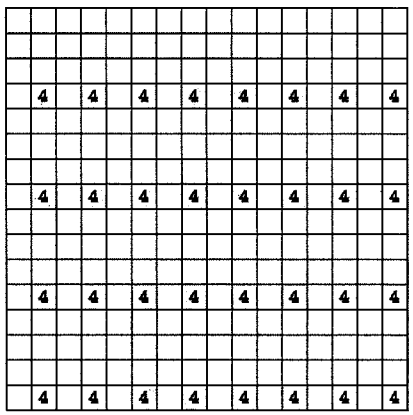
FIG. 12D is a diagram that illustrates the positions of dots formed in a fourth pass for forming the dot arrangement, as shown in FIG. 11.
Figure 12A:
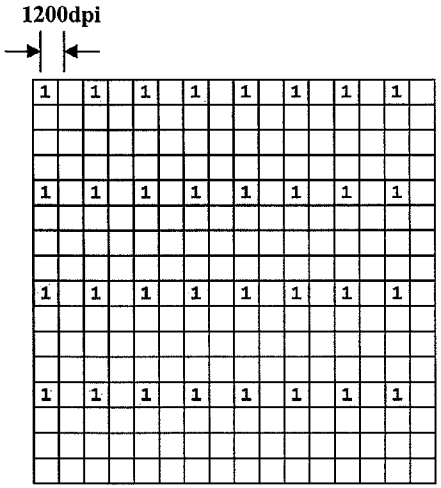
FIG. 12A is a diagram that illustrates the positions of dots formed in a first pass for forming the dot arrangement, as shown in FIG. 11.
Figure 12C:
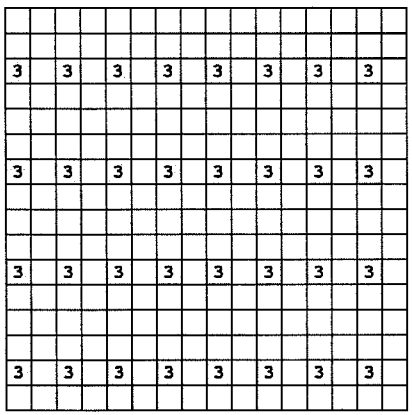
FIG. 12C is a diagram that illustrates the positions of dots formed in a third pass for forming the dot arrangement, as shown in FIG. 11.
Figure 12E:
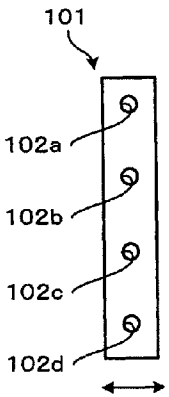
FIG. 12E is a plan view that illustrates the positions of nozzles of a inkjet head for forming the dot arrangement, as shown in FIG. 11.

As shown in FIG. 9C and FIG. 9D, dot columns may be formed during the third pass and the fourth pass by repeating the aforementioned process. After four passes, a dot arrangement with a plurality of dots dispersedly arranged in a staggered manner on the recording sheet of paper P may be formed, as shown in FIG. 8.

In the dot arrangement of FIG. 8, there may be portions at which dots are arranged adjacent to each other in transport direction 200, e.g., portions indicated by A in FIG. 8. Because the ejection timings of the four nozzles 30 are varied, these adjacent dots may result from the aforementioned liquid droplet ejecting process.

An advantage of the aforementioned liquid droplet ejecting process on print quality was tested by comparison between an example of an embodiment of the invention with a first and a second comparative examples.

The same ink jet head 3 which is configured to eject four-color inks, e.g., Y, M, C, and Bk, was employed for the example and for the first and the second comparative examples. Further, actuator unit 7 had a driving frequency which fluctuated within the range of ±2 to 3% with respect to the center frequency 26.0 kHz, due to uneven rotation of carriage drive motor 19. That is, the test was conducted under the condition in which print quality tends to decrease when crosstalk occurs.

The example of an embodiment of the invention employed the liquid droplet ejecting process shown in FIG. 9A-9E. The ejection timings of nozzles 30 adjacent to each other, i.e., nozzle 30*a* being adjacent to nozzle 30*c*, and nozzle 30*b* being adjacent to nozzle 30*d*, were offset from one another.

The first comparative example employed an existing liquid droplet ejecting process, as shown in FIGS. 12A-12E, in which liquid droplets were ejected simultaneously from all nozzles 30 that eject the same color ink, and then all nozzles 30 were prevented simultaneously from ejecting at the next time interval.

The second comparative example employed the liquid droplet ejecting method, as shown in FIGS. 10A-10E. In the second comparative example, the ejection timings of liquid droplets were varied in each of two nozzle columns 32A and 32B; however, the two nozzles 30 that belong to each of nozzle columns 32, e.g., nozzle 30*a* and nozzle 30*c*, and nozzle 30*b* and nozzle 30*d*, ejected liquid droplets in the same time interval. The second comparative example reduced the structural crosstalk due to mutual propagation of vibrations of diaphragm 40 and piezoelectric layer 41 between two nozzle columns 32A and 32B. Nevertheless, the second comparative example did not reduce the fluid crosstalk due to propagation of pressure waves among the nozzles in the same nozzle column, which communicate through manifold 27.

Printing were performed with ink jet head 3 by using each of the three ejection processes—the example, the first comparative example, and the second comparative examples. Print quality on the recording sheet of paper P was evaluated based on three scales by visually checking whether a longitudinal stripe is present due to uneven thickness. The evaluation results are shown in Table 1.

TABLE 1

| | Example | | First Comparative Example | | Second Comparative Example | |
|---|---|---|---|---|---|---|
| Ink | fwd | rvs | fwd | rvs | fwd | rvs |
| YCM | ○ | ○ | x | x | Δ | x |
| C | ○ | ○ | x | x | ○ | ○ |
| M | ○ | ○ | ○ | ○ | ○ | |
| CM | ○ | ○ | Δ | Δ | Δ | x |
| YC | ○ | ○ | x | x | ○ | ○ |
| YM | ○ | ○ | Δ | Δ | ○ | Δ |

In Table 1, "Y," "C," and "M" in the column of ink type respectively represent yellow ink, cyan ink and magenta ink. "YCM" indicates that three color inks of yellow, cyan and magenta were used simultaneously. The nozzle columns of the ink jet head, which respectively eject four color inks, were arranged in the scanning direction in the order of black (Bk), cyan (C), yellow (Y) and magenta (M). "fwd" indicates liquid droplet ejection when carriage 2 was moved in one scanning direction, and "rvs" indicates liquid droplet ejection when carriage 2 was moved in the scanning direction opposite to that of "fwd." The symbol "○" indicates a state in which no longitudinal stripe was recognized visually, the symbol "Δ" indicates a state in which a longitudinal stripe was recognized slightly, and the symbol "x" indicates a state in which a longitudinal stripe was recognized clearly.

As shown in Table 1, when the example process of liquid droplet ejection according to an embodiment of the invention was used, no longitudinal stripe was present, and good print quality was obtained. On the other hand, in the first comparative example in which liquid droplets were ejected from all nozzles 30 simultaneously, a clearly recognizable longitudinal stripe was present. In the second comparative example in which the ejection timings were varied among the nozzle columns 32, but not varied among the adjacent nozzles 30, a slightly visible longitudinal stripe was present.

Ink jet head 3 of the above embodiment may comprise two nozzle columns 32A and 32B that respectively communicate with the two manifolds 27. In another embodiment, the number of nozzle columns 32 may be one or three or more. Irrespective of the number of the nozzle columns 32, the ejection timings of nozzles 30 corresponding to any two pressure chambers 24 located adjacent to each other in the arranged direction among the plurality of nozzles 30 that form each nozzle column 32, may vary.

In an embodiment, when low resolution first dot data acquired from the input device 60, such as a general purpose computer or a PC, are converted into second dot data in a staggered arrangement, as shown in FIG. 8, by the data conversion portion 51, each first region may be divided into two regions in the scanning direction and into two in the transport direction; respectively, thus, each first region may be divided into four second regions, as shown in FIG. 7. In another embodiment, each first region may be divided into three or more regions in the scanning direction or in the transport direction.

In another embodiment, in order to mainly reduce data transmission time by reducing transmission print data, the low resolution first dot data acquired from the input device 60, such as a general purpose computer or a PC, may be converted into the second dot data in a staggered arrangement, as shown in FIG. 8, by the data conversion portion 51. In another embodiment, in order to enhance print speed, the number of dots may be reduced from dots of complete high resolution printing, e.g., dots in 1200 dpi may be dispersedly arranged to obtain print quality approaching that of the high resolution printing. It is not necessary to convert dot data at the printer side. Thus, data corresponding to the second dot data may be input directly from input device 60.

In still another embodiment, the low resolution first dot data, e.g., 600 dpi, may be converted into second dot data, e.g., 1200 dpi, having twice dot data vertically and horizontally, respectively, by data conversion portion 51. The low resolution first dot data may be converted into twice or more data size of dot data, e.g., three times (1800 dpi) or four times (2400 dpi).

In yet another embodiment, the dot intervals, e.g., dot resolution, may be the same between scanning direction 100 and transport direction 200. In still yet another embodiment, the dot intervals may be varied between scanning direction 100 and transport direction 200.

In a further embodiment, during the first pass, each of the nozzles alternately may perform liquid droplet ejection and may be prevented from ejecting liquid droplets. In still a further embodiment, prevention of the ejection of liquid droplets may continue for a plurality of ejection time intervals.

In yet a further embodiment, the ink jet head 3 with piezoelectric actuator unit 7 may be used for liquid droplet ejections. In still yet a further embodiment, another type of actuator which receives electrical driving signal for performing printing may be employed.

The drive control may be executed selectively, based on a print mode specified by a user. The user may be able to select, at the time of print command, a print speed priority mode, e.g., draft mode, which is selected when a printed material needs to be obtained by giving a priority to the printing speed, and a print quality priority mode which gives a priority to print quality. The ink jet printer may perform printing in print quality priority mode by executing liquid droplet ejection process similar to the one performed in the example, and may perform printing in the print speed priority mode by executing liquid droplet ejection process similar to the one performed in the first comparative example.

The embodiment and its alternative embodiments described above represent the case in which the invention is applied to an ink jet printer that records an image or the like, on a recording sheet of paper by ejecting ink. Nevertheless, application of the invention is not limited to the one used for the above application. That is, the invention may be applied to various liquid droplet ejecting apparatuses that eject various types of liquid, other than ink, onto a target (ejected target element) depending on the application purpose.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid droplet ejecting apparatus comprising:

a liquid droplet ejecting head configured to eject liquid droplets onto the ejected target element to form a plurality of dots arranged at predetermined dot intervals in a plurality of dot columns, the liquid droplet ejecting head comprising:

a flow passage unit comprising:

a plurality of individual flow passages arranged in a transport direction substantially perpendicular to the scanning direction, the plurality of individual flow passages comprising a first individual flow passage and a second individual flow passage adjacent to the first individual flow passage in the transport direction;

at least one common liquid chamber configured to be in fluid communication with each of the plurality of individual flow passages; and a plurality of nozzles comprising a first nozzle and a second nozzle adjacent to the first nozzle in the transport direction, wherein the first nozzle is configured to fluidly communicate with the first individual flow passage, and the second nozzle is configured to fluidly communicate with the second individual flow passage; and an actuator unit configured to selectively pressurize liquid in one of the first individual flow passage and the second individual flow passage, thereby ejecting liquid droplets from the corresponding one of the first nozzle and the second nozzle; and a control unit configured to control the actuator unit and the liquid droplet ejecting head, wherein the control unit controls the actuator unit to eject a liquid droplet from the first nozzle during an ejection time interval, then subsequently control the liquid droplet ejecting head to move a predetermined distance in the scanning direction, then subsequently suspend the first nozzle from ejecting, and control the actuator unit to eject a liquid droplet from the second nozzle, wherein the predetermined distance is less than the predetermined dot interval, wherein the control unit controls the actuator unit to eject dots such that positions of the plurality of dots formed in a first dot column are offset from positions of the plurality of dots formed in second dot column adjacent to the first dot column in the scanning direction.

2. The liquid droplet ejecting apparatus according to claim 1, wherein each of the plurality of nozzles is in fluid communication with a respective one of the plurality of flow passage units.

3. The liquid droplet ejecting apparatus according to claim 2, wherein the plurality of nozzles are arranged on the liquid droplet ejecting head in a plurality of nozzle columns arranged in the scanning direction, and the at least one common liquid chamber comprises a plurality of common liquid chambers, and each of the plurality of nozzle columns corresponds to one of the plurality of common liquid chambers, and wherein the control unit controls the actuator unit such that any two nozzles of the plurality of nozzles that are adjacent to each other in the transport direction, and are positioned in the same nozzle columns, eject ink at time intervals that do not overlap.

4. The liquid droplet ejecting apparatus according to claim 2, further comprising:

a data acquisition unit configured to acquire first dot data comprising information for forming dots in a plurality of first regions on the ejected target element; and a data conversion unit configured to convert the first dot data into second dot data comprising information for forming dots in a plurality of second regions on the ejected target element, wherein each of the plurality of first regions corresponds to two or more of the plurality of second regions, and the data conversion unit is configured to generate the second dot data such that for each of two adjacent second dot regions of the two or more second dot regions that correspond to one of the plurality of first regions, a dot is formed only in one of the two adjacent dot regions of the two or more second dot regions that correspond to one of the plurality of first dot regions.

5. The liquid droplet ejecting apparatus according to claim 4, wherein the data conversion unit is configured to also generate the second dot data such that, for each of two of the plurality of first regions adjacent to each other, a dot is formed only in one of an adjacent two second regions that are located adjacent to each other in the scanning direction, wherein each of the two adjacent second regions correspond to adjacent first regions.

6. The liquid droplet ejecting apparatus according to claim 5, wherein two of the plurality of nozzle columns arranged in the scanning direction at positions offset by a distance equal to half of the predetermined dot interval in the transport direction, and two of the plurality of common liquid chambers respectively correspond to the two nozzle columns.

7. The liquid droplet ejecting apparatus according to claim 5, wherein a dot formed in each second region comprises a plurality of liquid droplets ejected from one nozzle.

8. The liquid droplet ejecting apparatus according to claim 5, wherein each of the plurality of first regions corresponds to four second regions, such that the first region is divided into two second regions in the scanning direction and into two second regions in the transport direction.

9. The liquid droplet ejecting apparatus according to claim 5, wherein the data conversion unit generates second dot data, such that for each first region, dots are formed only in the second regions that are offset in both the scanning direction and in the transport direction.

10. The liquid droplet ejecting apparatus according to claim 1, further comprising a transport unit configured to transport the ejected target element in the transport direction.

* * * * *